United States Patent [19]

Kanamaru et al.

[11] Patent Number: 4,924,690

[45] Date of Patent: May 15, 1990

[54] METHOD AND APPARATUS FOR PLASTICALLY FORMING HELICAL INTERNAL GEARS AND HELICAL GEARS

[75] Inventors: Hisanobu Kanamaru, Hitachi; Susumu Aoyama; Tsutomu Koike, both of Misato; Naotatsu Asahi; Yoshiki Hirai, both of Matsudo, all of Japan

[73] Assignees: M. H. Center Limited, Saitama; Hitachi Powdered Metals Co., Ltd., Chiba, both of Japan

[21] Appl. No.: 287,396

[22] Filed: Dec. 20, 1988

[30] Foreign Application Priority Data

Dec. 26, 1987 [JP] Japan ..... 62-330926

[51] Int. Cl.[5] ..... B21K 01/30

[52] U.S. Cl. ..... 72/343; 72/264; 29/893.34

[58] Field of Search ..... 72/264, 343, 352, 354, 72/359; 29/159.2

[56] References Cited

U.S. PATENT DOCUMENTS 3,564,894 2/1971 Sharon ..... 72/343

4,509,353 4/1985 Ike et al. ..... 29/159.2

4,739,644 4/1988 Maki et al. ..... 29/159.2

4,785,648 11/1988 Budrean et al. ..... 72/353

*Primary Examiner*—Lowell A. Larson

*Attorney, Agent, or Firm*—Kalish & Gilster

[57] ABSTRACT

The present invention is to extrude helical internal gears and helical gears by pushing materials processed to any type of blank into a die unit successively by use of a punch, i.e., by passing the materials once through the die unit. The invention is directed to a die unit comprising an outer contour restraining container into which metal material blanks each having a central bore are to be inserted, a die placed contiguously below the container, these container and die being arranged to be circumferentially rotatable relative to each other, and upper and lower mandrels disposed inside the container and the die in alignment with their axes, respectively, and interconnected for being circumferentially rotatable relative to each other, the metal materials being successively pushed into gaps between the upper mandrel and the container and between the lower mandrel and the die by means of a punch to mold helical internal gears.

4 Claims, 10 Drawing Sheets

METHOD AND APPARATUS FOR PLASTICALLY FORMING HELICAL INTERNAL GEARS AND HELICAL GEARS

BACKGROUND OF THE INVENTION

The present invention relates to a method and an apparatus for plastically forming helical internal gears and helical gears, and more particularly to a plastically forming method and apparatus for extruding internal helical gears and helical gears by pushing materials processed to any type of blank into a die unit successively by means of a punch, i.e., by passing the materials once through the die unit.

To date, there have been known several apparatuses for plastically extruding helical gears which have helical teeth, as disclosed in U.S. Pat. No. 3,605,475 and No. 3,910,091 by way of example.

Such a helical gear extruding apparatus comprises a combination of a die having a helical gear toothed section formed on its inner wall surface, a container integral with the die, a mandrel disposed in alignment with the axes of the die and the container, and a punch for pushing metal material blanks into the container and the die successively to thereby extrude helical gears.

In the helical gear extruding apparatus as mentioned above, while the mandrel and the die are circumferentially rotatable relative to each other, the die is integral with the container, and the metal material blank being pushed is not circumferentially rotatable relative to the die. Therefore, when the metal material is pushed into the die to form helical teeth on the outer peripheral surface of the metal material, the material is subjected to axial flow (extension), which acts to form the product toothed portion with a smaller helical angle than that of the die toothed portion and hence produces a lead gap between the die toothed portion and the material toothed portion under molding. From this there may arise a problem. Specifically, great stress is produced on the surfaces of the respective teeth of the die and the metal material on one side, causing a pressure difference between the left-hand and right-hand sides of the molded toothed portion, including elastic recovery, with respect to the die toothed portion. This may cause the molded toothed portion to seize or bite the die toothed portion. In the worst case, the die toothed portion would be damaged.

Further, in order to prevent axial extension of the metal material during extrusion, the above-cited U.S. Pat. No. 3,605,475 adopts a technique to make the hollow portion of the metal material free from constraint by omitting the mandrel, and hence allow flow of the material toward the inner peripheral side thereof.

While this technique is effective in reducing the lead gap, it gives rise to a problem that high-accuracy helical teeth cannot be obtained because of reduction in the three-dimensional constraint force acting from the inner and outer peripheral surfaces of the material and in the axial direction thereof during flow deformation. Another problem is that accuracy of the inner diameter of the helical gear is reduced as well.

At present, therefore, although several techniques for plastically forming helical gears have been proposed as disclosed in the above-cited U.S. Patents, the technology capable of mass-producing helical gears on an industrial basis has not yet been established. Thus, notwithstanding the fact that helical gears are principal components suitable for transmitting rotation in many machines, including transmissions for automobiles and motorcycles, they are currently formed by cutting with gear hobbing machines. In addition, no methods of plastically formed helical terminal gears have been reported in Japan or elsewhere in the world. As with the above case, notwithstanding the fact that internal helical gears are principal components suitable for transmitting rotation in many machines, including transmissions for automobiles and motorcycles, they are currently formed by cutting with broaching machines.

SUMMARY OF THE INVENTION

The present invention has been accomplished with a view to solving the problems as set forth above, and has for its object to provide a method and an apparatus for plastically forming helical internal gears and helical gears which can eliminate the occurrence of a lead gap as well as seizure, biting or the like between a die and a material caused thereby, and which can realize mass-production of helical internal gears and helical gears on an industrial basis.

A method of plastically forming a helical internal gear according to the present invention, employs a helical internal gear extruding die unit consisting of an outer contour restraining container into which metal material blanks each having a central bore are to be inserted, a die placed contiguously below the container, the container and the die being arranged to be circumferentially rotatable relative to each other, an upper mandrel for guiding, and a lower mandrel formed on its outer circumference with a toothed section with a desired helical angle for forming helical teeth of the helical internal gear, the upper and lower mandrels being disposed inside the outer contour restraining container and the die in alignment with their axes, respectively, and being interconnected to be circumferentially rotatable relative to each other, the method comprising the steps of; pushing the metal materials successively into gaps between the upper mandrel and the outer contour restraining container and between the lower mandrel and the die by means of a punch; contracting each of the metal mandrels by an inwardly contracted portion of the die to define the sectional area as necessary to mold the helical internal gear, when the metal material passes between the die and the lower mandrel; and subjecting the inner peripheral portion of the metal material to flow deformation from an incomplete toothed shape to a complete toothed shape as it goes from the upper end of an approach area in the toothed section of the lower mandrel toward the lower end thereof, the metal material when passing between the approach area and a material outer periphery expanding portion of the die located in facing relation to the former; and during the above steps the lower mandrel being allowed to rotate due to relative rotational forces produced between the metal material and the lower mandrel caused by the helical angle of the toothed section, and also, due to effective expansion of the inner diameter of the metal material during the toothed shape forming process, flow material being absorbed by the material outer periphery expanding portion which is inclined expansively in complementary relation to the approach area of the lower mandrel, thereby keeping constant the horizontal sectional area of the metal material throughout the region of material flow deformation in the die unit.

Herein, the expression that the horizontal sectional area is "constant" conceptually means that the sectional area reduction rates at respective layers are all equal to 0%. In engineering practice, however, it is inevitable that the sectional area reduction rate of about 1% occurs for each layer having an axial distance of 0.5 mm. The reasons are that it is very difficult to measure the accurate sectional area at respective layers of a complicated solid configuration which includes a shape of helical teeth, a conical shape, and a corner shape made blunt rather than sharp for integrity of the die unit, and that a negative sectional area reduction rate at any layer is meaningless for extrusion which is based on a condition of establishing a three-dimensional compression stress field.

An apparatus for plastically forming a helical internal gear according to the present invention comprises: an outer contour restraining container into which metal material blanks each having a central bore are to be inserted; a die placed contiguously below the outer contour restraining container and arranged to be circumferentially rotatable relative to the container; an upper mandrel disposed inside the outer contour restraining container in alignment with its axis; a lower mandrel connected to the lower end of the upper mandrel for being circumferentially rotatable relative to the upper mandrel and disposed in the die in alignment with its axis; and a punch for successively pushing the metal material blanks into gaps between the upper mandrel and the outer contour restraining container and between the lower mandrel and the die, wherein the outer peripheral wall of the lower mandrel has formed therein an approach area in which the peripheral surface is gradually varied into a toothed shape of the helical internal gear as it goes ahead from the upper end thereof in the extruding direction of the metal material, and a product configuration area continuously extended from the approach area and having the toothed shape of the helical internal gear, and wherein the inner peripheral surface of the die has formed therein an inwardly contracted portion located facing the start end of the approach area of the lower mandrel for contracting the metal material to define its sectional area as necessary for molding the helical internal gear, an outer periphery expanding portion located facing the approach area of the lower mandrel for expansively deforming the outer periphery of the metal material to keep constant the horizontal sectional area thereof despite effective expansion of the inner diameter of the metal material during the flow deformation process in which the inner peripheral portion of the metal material is formed gradually into the toothed shape of the helical internal gear by the approach area, and an outer periphery forming portion located facing the product configuration area of the lower mandrel for defining the outer diameter of the molded product to the normal size.

A method of plastically forming a helical gear according to the present invention employs a helical gear extruding die unit consisting of an outer contour restraining container into which metal material blanks each having a central bore are to be inserted, a die placed contiguously below the container, the container and the die being circumferentially rotatable relative to each other, and a mandrel disposed inside the outer contour restraining container and the die in alignment with their axes, and arranged to be circumferentially rotatable relative to each other, the method comprising the steps of: pushing the metal material blanks successively into gaps between the mandrel and the outer contour restraining container as well as the die by means of a punch; defining the sectional area of the metal material necessary to mold the helical gear by sectional area reduction rate adjusting portion of the mandrel, when the metal material passes between the die and the mandrel; and subjecting the outer peripheral portion of the metal material to flow deformation from incomplete toothed shape to complete toothed shape as the material goes from the upper end of an approach area in a toothed section of the die for molding helical teeth toward the lower end thereof, when the metal material passes between the approach area and a material inner periphery forming portion of the mandrel located in facing relation to the former. During the above steps the die is allowed to rotate due to relative rotational forces produced between the metal material and the die caused by the helical angle of the toothed section, and also, due to effective contraction of the outer diameter of the metal material during the toothed shape forming process, flow material is absorbed by the material inner periphery forming portion which is inclined contractedly in complementary relation to the approach area of the die, thereby keeping constant the horizontal sectional area of the metal material throughout the region of material flow deformation in the die unit.

An apparatus for plastically forming a helical gear according to the present invention comprises: an outer contour restraining container into which metal material blanks each having a central bore are to be inserted; a die placed contiguously below the outer contour restraining container and arranged to be circumferentially rotatable relative to the container; a mandrel disposed inside the outer contour restraining container and the die in alignment with their axes; and a punch for successively pushing the metal material blanks into gaps between the mandrel and the outer contour restraining container as well as the die, wherein the inner peripheral wall of the die has formed therein an approach area in which the peripheral surface is gradually varied into the toothed shape of the helical gear as it goes ahead from the upper end thereof in the extruding direction of the metal material, and a product configuration area continuously extended from the approach area and having the toothed shape of the helical gear, and wherein the outer peripheral surface of the mandrel has formed therein a sectional area reduction rate adjusting portion located in a position near the outer contour restraining container for expanding the metal material to define its sectional area necessary for molding the helical gear, an inner periphery forming portion located facing the approach area of the die for contractedly deforming the inner periphery of the metal material to keep constant the horizontal sectional area thereof despite effective contraction of the outer diameter of the metal material during the flow deformation process in which the outer peripheral portion of the metal material is formed gradually into the toothed shape of the helical gear by the approach area, and a column portion located facing the product configuration area of the die for defining the inner diameter of the molded product to the normal size.

According to the present invention, when each of the metal material blanks successively pushed by the punch into the gap between the container and the mandrel passes the outwardly expanded portion of the mandrel, the metal material is expanded to the sectional area necessary for molding the helical gear, and when it passes the approach area of the die and the material inner periphery forming portion of the mandrel, both defined in facing relation, the outer peripheral portion of the metal material is subjected to flow deformation from incomplete toothed shape to complete toothed shape following the configuration of the approach area. Simultaneously, the flow material caused by effective contraction of the outer diameter of the metal material during the above process of tooth deformation is absorbed by the presence of the material inner periphery forming portion which is inclined contractedly in complementary relation to the approach area, so that the metal material is prevented from undergoing flow extension in the axial direction of the mandrel, and the occurrence of lead gap is avoided. Also, since the container and the die are circumferentially rotatable relative to each other, it is possible to prevent seizure or biting between the metal material and the die, as well as damage to the teeth.

Further, according to the present invention, when each of the metal material blanks successively pushed by the punch into the gaps between the container and the upper and lower mandrels passes the inwardly contracted portion of the die, the metal material is contracted to the sectional area necessary for molding the helical internal gear, and when it passes the approach area of the lower mandrel and the material outer periphery forming portion of the die both defined in facing relation, the inner peripheral portion of the metal material is subjected to flow deformation from incomplete toothed shape to complete toothed shape following the configuration of the approach area. Simultaneously, the flow material caused by effective expansion of the inner diameter of the metal material during the above process of tooth deformation is absorbed by the presence of the material outer periphery forming portion which is inclined expansively in complementary relation to the approach area, so that the metal material is prevented from undergoing flow extension in the axial direction of the mandrel, and the occurrence of lead gap is avoided. Also, since the container and the die as well as the upper and lower mandrels are circumferentially rotatable relative to each other, it is possible to prevent seizure or biting between the metal material and the die, as well as damage of the teeth.

DESCRIPTION OF THE PREFERRED EMBODIMENT

One embodiment of the present invention will be described hereinafter with reference to FIGS. 1 to 5.

Figure 1:
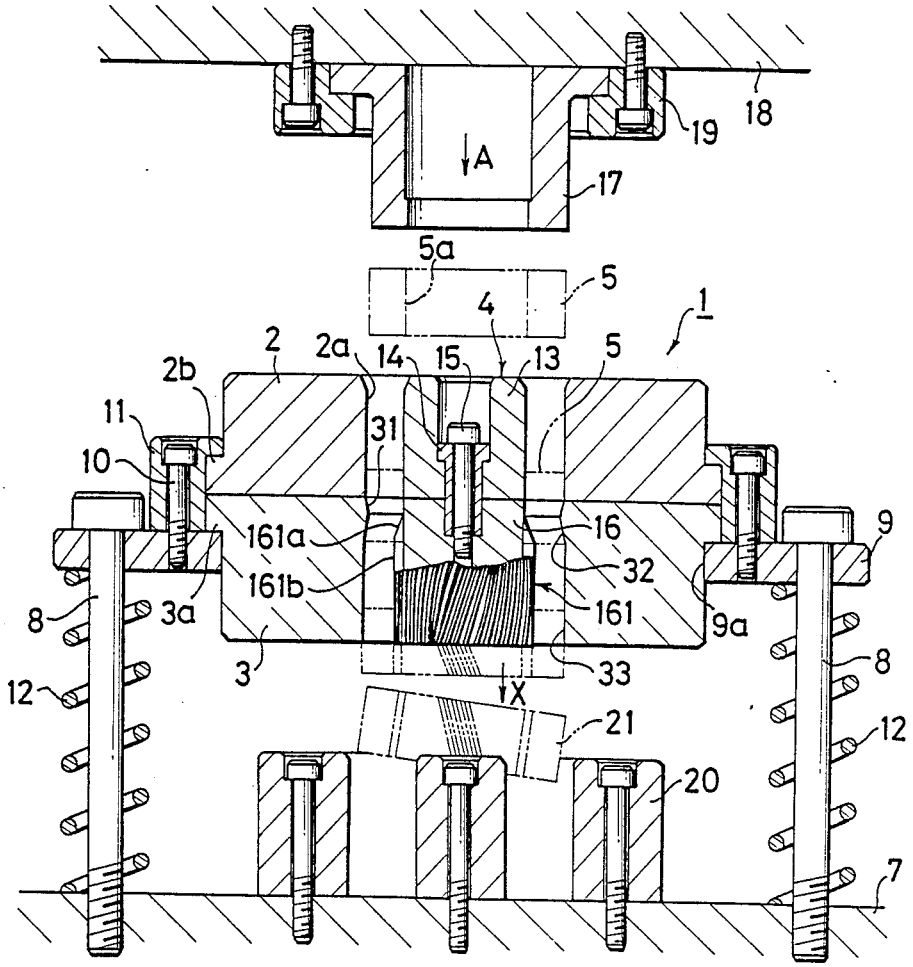
FIG. 1 is a sectional view showing one example of an apparatus for plastically forming helical internal gears according to the present invention.
Figure 2:
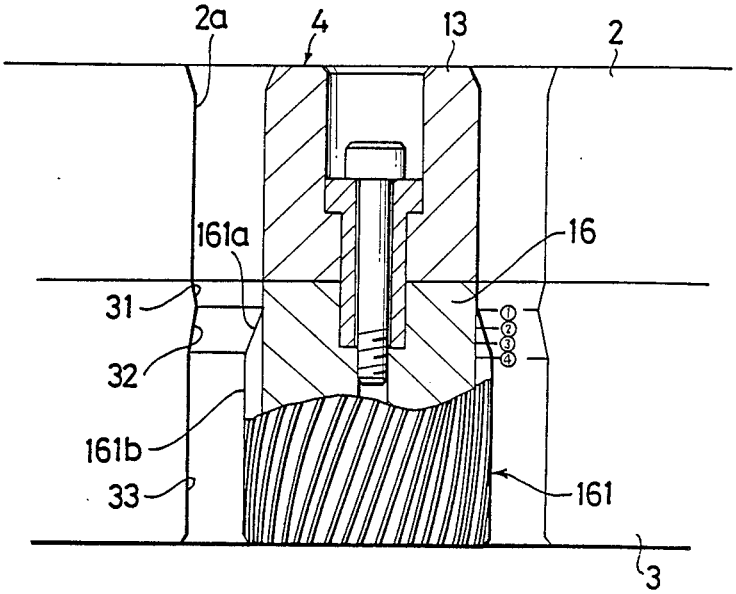
FIG. 2 is an enlarged sectional view of an essential part of the apparatus.
Figure 3:
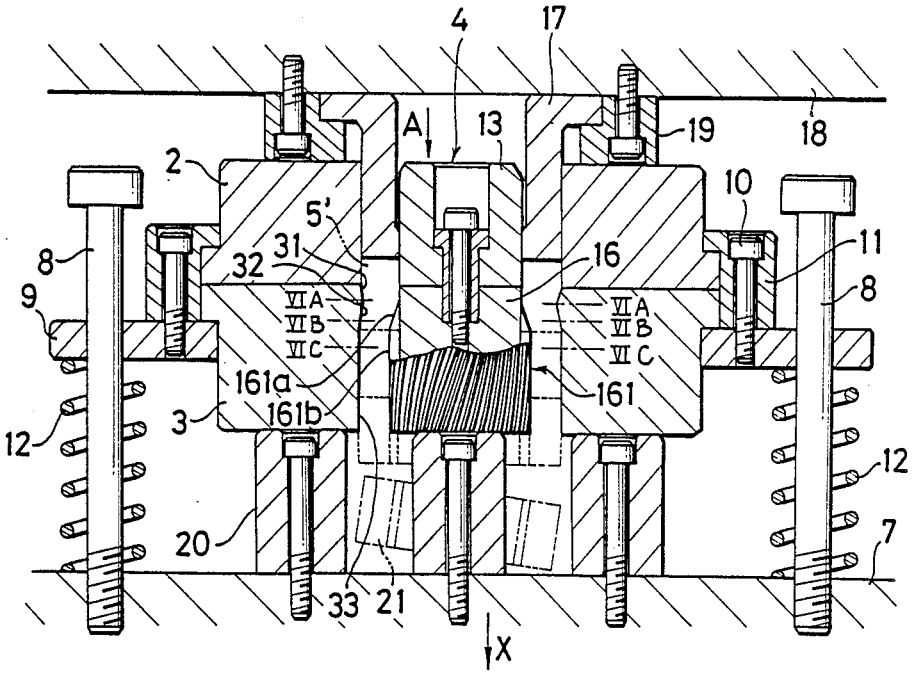
FIG. 3 is a sectional view showing the state that a metal material is pushed into a die to extrude a helical internal gear.

FIG. 1 is a sectional view showing the entire construction of an apparatus for plastically extruding helical internal gears according to the present invention, FIG. 2 is an enlarged sectional view of an essential part of the apparatus, and FIG. 3 is a sectional view showing the state that a metal material blank is pushed into a die to extrude a helical internal gear.

In FIGS. 1 to 3, a helical internal gear extruding die unit generally designated at reference numeral 1 comprises a container 2, a die 3 and a mandrel 4. At the center of the container 2, there is defined a material insertion bore 2*a* which is vertically penetrating through the container and serves to restrain the outer periphery of a metal material blank 5.

The die 3 is to form the outer periphery of the metal material blank 5 by pushing it into the die 3, and is rotatably fitted in an attachment hole 9*a* of a support plate 9 vertically movably supported to a plurality of upstanding guide rods 8 which are in turn attached to a stationary base 7 such as a bolster. The container 2 is placed over the upper surface of the die 3 with their axes aligned exactly. The container 2 and the die 3 have formed in their outer circumferences respective flanges 2*b*, 3*a* at which they are supported on the support plate 9 by a ring-like holder 11, fixed to the support plate 9 by means of bolts 10, for being circumferentially rotatable relative to each other. The support plate 9 is normally urged upward by compression springs 12 each disposed between the support plate 9 and the stationary base 7 around the guide rod 8 in concentric relation.

The mandrel 4 consists of an upper mandrel 13 which is positioned inside the material insertion bore 2*a* of the container 2 for guiding the metal material blank 5 when its central bore 5*a* is fitted over the upper mandrel 13, and a lower mandrel 16 which is disposed contiguously below and coupled to the upper mandrel 13 through a joint sleeve 14 and a bolt 15 with their axes aligned exactly such that the upper and lower mandrels are rotatable relative to each other. The lower mandrel 16 has defined on its outer circumference a toothed section 161 with a desired helical angle for molding helical teeth of the helical internal gear. As shown in FIG. 2, the toothed section 161 comprises an approach area (tooth deformation process area) 161*a* expanding linearly radially outward from the outer peripheral surface of the lower mandrel 16 as it goes ahead in the extruding direction of the metal material 5 (i.e., the direction of arrow X in FIGS. 1 and 3), and a product configuration area 161*b* extending downward continuously from the lower end of the approach area 161*a* to form the complete shape of helical gear teeth. In the approach area 161*a*, each tooth has such sectional configurations at respective positions 1–4 that a tooth groove width d is gradually reduced in accordance with the involute curve of the molded tooth as it proceeds from the start end of the approach area 161*a* toward 161*b*, as indicated by 1–4 in FIG. 4. This increases flextural rigidity of the start end portion of the approach area 161*a* (i.e., the portion corresponding to 2) from which the metal material blank 5 starts to undergo flow deformation along the approach area 161*a*, and also enables smooth transition process of the metal material blank 5 to the helical internal gear teeth through flow deformation.

On the inner peripheral surface of the die 3, there is defined an inwardly contracted portion 31 which causes the outer peripheral portion of the metal material blank 5 to be subjected to flow deformation gradually in the contracting direction, and which is located to face the start end of the approach area 161*a* of the lower mandrel 16. The inner peripheral surface of the die 3 has also a material outer periphery expanding portion 32 which is radially outwardly inclined from the top corresponding to the minimum inner diameter of the inwardly contracted portion 31 toward the extruding direction of the material (i.e., the direction of arrow X). The material outer periphery expanding portion 32 is located to face the approach area 161*a* of the lower mandrel 16 in complementary inclining relation thereto, and serves to restrain the outer periphery of the metal material blank 5 while allowing it to expand outward in response to effective expansion of the inner diameter of the metal material blank 5 during the process in which the inner peripheral portion of the metal material blank 5 is subjected to flow deformation gradually from the circular cross-section to the helical internal gear teeth by virtue of the approach area 161*a* of the lower mandrel 16. Designated at 33 is a material outer periphery forming portion located to face the product configuration area 161*b*.

In addition, designated at 17 in FIGS. 1 and 3 is a cylindrical punch supported to the underside of a slider 18 by a holder 19. The punch 17 is to push the metal material blank 5 into a gap between the mandrel 4 and the container 2 as well as the die 3, and is supported in such an arrangement as making it rotatable circumferentially relative to the slider 18.

Operation of extruding helical internal gears using the die unit 1 thus constructed will be described below.

First, as shown in FIG. 1, the hollow metal material blank 5 with predetermined thickness and outer diameter is inserted into the bore 2*a* of the container 2, and the slider 18 is operated to descend in the direction of arrow A with the central bore 5*a* of the metal material blank 5 fitted over the upper mandrel 13. When the punch 17 is thereby engaged with the upper end of the metal material blank 5 and then further moved downward, the support plate 9 is wholly descended against the compression springs 12, along with the container 2, the die 3 and the mandrel 4. At the time the lower end surfaces of both the die 3 and the lower mandrel 16 strike against the upper surface of a receiver stand 20 fixedly mounted on the stationary base 7, the downward movement of the container 2, the die 3 and the mandrel 4 is stopped.

In such state, when the slider 18 is advanced in the direction of arrow A causing the punch 17 to be descended at a full stroke, the metal material is pushed more deeply in the gap between the container 2 and the mandrel 4 in the extruding direction as indicated by arrow X, and it finally reaches a position straddling both the container 2 and the die 3 as indicated by reference numeral 5' in FIG. 3.

At the time the metal material is pushed into the die 3 from the container 2 by means of the punch 17, the metal material blank 5' is contracted by the presence of the inwardly contracted portion 31 of the die 3 for being defined to the sectional area necessary to mold the helical internal gear. Then, the inner peripheral portion of the metal material at its lower end enters the approach area 161*a* of the toothed section 161 of the lower mandrel 16 for molding the helical teeth, whereupon the helical teeth start to be molded on the metal material blank 5'. The material deformation as experienced in the inner peripheral portion of the metal material blank 5' at this time corresponds to the sectional configuration of the approach area 161*a* as indicated by 2 in FIG. 2.

Upon completion of full-stroke pushing of the first metal material blank 5' by the punch 17, the punch 17 is raised up and a next metal material blank 5 is inserted into the container 2, as shown in FIG. 1, followed by moving the punch 17 again downward to push the next metal material blank 5 into the container 2. Thereafter, by successively pushing subsequent metal material blanks 5 into the container 2 by the punch 17 in a like manner, the metal material blanks 5 are moved through the gap between the die 3 and the mandrel 4 one by one in the direction of arrow X. During passage through the gap between die 3 and mandrel 4, each metal material 5 is plastically formed into a helical internal gear having helical teeth on the inner circumference thereof.

Figure 5:
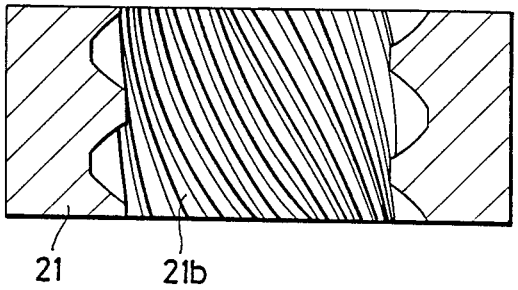
FIG. 5 is a sectional view of a molded helical internal gear.

In other words, when the metal material blank 5 passes the approach area 161*a* of the lower mandrel 16, the inner peripheral portion of the metal material blank 5 is subjected to flow deformation gradually from the circular cross-section to the complete shape of helical teeth. After that, while passing through the gap between the product configuration area 161*b* and the material outer periphery expanding section 32 of the die 3 both defined in facing relation, the metal material is molded into a helical internal gear 21 which has perfect helical teeth 21*a* formed in its inner peripheral portion, and has its outer periphery 21*b* formed into the predetermined diameter by the material outer periphery expanding portion 32, as shown in FIG. 5. The helical internal gear 21 is dropped into the receiver stand 20.

In this connection, when each of the metal material blanks 5 successively pushed from above by the punch 17 passes the gap between the approach area 161*a* in the toothed section 161 of the lower mandrel 16 and the material outer periphery expanding portion 32 of the die 3 both defined in facing relation, the inner peripheral portion of the metal material blank 5 is subjected to flow deformation from incomplete toothed shape to complete toothed shape as it goes down from the upper end of the approach area 161*a* to the lower end thereof. Simultaneously, the flow material caused by effective expansion of the inner diameter of the metal material blank 5 during the above process of tooth deformation is absorbed by the presence of the material outer periphery expanding portion 32 which is inclined expansively in complementary relation to the approach area 161*a*, so that the metal material blank 5 is prevented from undergoing flow extension in the axial direction of the mandrel 4.

Thus, reduction in the horizontal sectional area of the metal material blank 5 caused by flow deformation of the inner peripheral portion of the metal material blank 5 from the circular cross-section to the helical toothed shape is compensated by such an arrangement that the material outer periphery contracting portion 32 of the die 3 serving to restrain the outer periphery of the metal material blank 5 is designed to vary in its diameter corresponding to changes in the sectional configuration of the inclined approach area 161*a*, thereby keeping constant the horizontal sectional area of the metal material blank 5 throughout the region of material flow deformation in the die unit.

FIG. 6 is a set of explanatory views showing the fact that the sectional areas at respective horizontal planes of the metal material are kept constant throughout the molding process of the helical internal gear in the die unit.

Figure 6A:
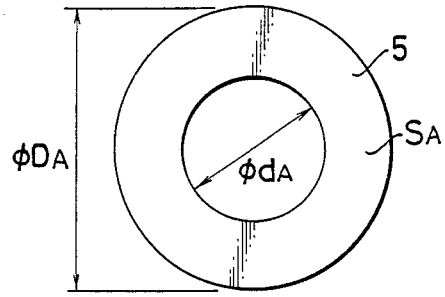
FIGS. 6(A) to 6(C) are explanatory views showing respective horizontal cross-sectional states in the flow deformation process of the material according to the embodiment of the present invention.
Figure 6B:
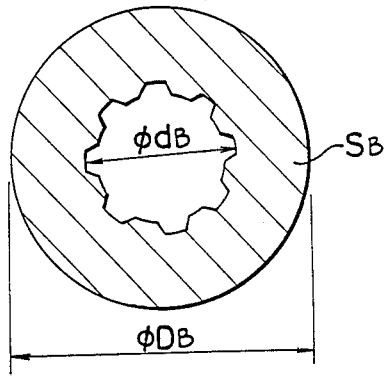
Figure 6C:
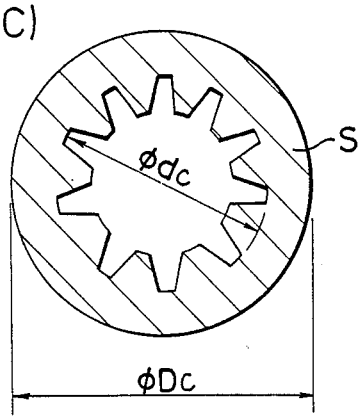

FIG. 6(A) shows a section of the metal material blank 5 at the horizontal plane taken along the line VIA—VIA in FIG. 3, FIG. 6(B) shows a section of the metal material blank 5 under molding at the horizontal plane taken along the line VIB—VIB in FIG. 3, and FIG. 6(C) shows a section of the final product at the horizontal plane taken along the line VIC—VIC in FIG. 3.

As will be apparent from those figures, the section area $S_A$ of the metal material blank 5 being inwardly contracted by the inwardly contracting portion 31 of the die 3, the sectional area $S_B$ of the metal material during flow deformation, and the sectional area S of the completed gear are equal to each other, i.e., $S_A=S_B=S$, although the respective outer diameters $\emptyset D_A$, $\emptyset D_B$ and $\emptyset D_C$ exhibit the relationship of $\emptyset D_C>\emptyset D_B>\emptyset D_A$.

Accordingly, the material extension in the axial direction of the metal material blank 5 is prevented, and there occurs no gap between the lead of the incomplete toothed shape formed in the inner circumference of the material and the lead of the lower mandrel toothed section held in contact with the former, even in the transition process from the approach area 161*a* of the lower mandrel 16 to the product configuration area 161*b* for molding the complete toothed shape. Also, there occurs no lead error in the direction of advancement between the section of teeth molded in the inner circumference of the material and the corresponding section of teeth of the lower mandrel 4, whereby perfect helical teeth are formed in the inner circumference of the material.

In addition, when the metal material blank 5 is pushed downward by the punch 17, it passes the toothed section 161 of the lower mandrel 16 while undergoing flow deformation, relative rotational forces are produced between the metal material blank 5 and the lower mandrel 16 due to the helical angle of the toothed section 161. Stated otherwise, for the lower mandrel 16 to be held stationary, the entire metal material blank 5 is necessarily forced to rotate due to the helical lead of the toothed section 161 when the metal material blank 5 is pushed to come into the toothed section 161 of lower mandrel 16. In this state, because the most part of the metal material is in the container 2, the metal material has to rotate by overcoming the frictional resistance between the container 2, as well as the upper mandrel 13 and the metal material, if the die 3 and the upper mandrel 13 are integral with the container 2 and the lower mandrel 16, respectively, or if the relative rotational movement is restricted between the die 3 and the container 2 and between the upper and lower mandrels 13, 16. At this time, a portion of the metal material blank 5 just enters the approach area 161*a* of the lower mandrel 16, and hence rotation of the metal material blank 5 produces extreme stress in the approach area 161*a*. As a result, the metal material blank 5 would be deformed unnecessarily, or the toothed section 161 of the lower mandrel would be damaged.

In this embodiment, however, since the container 2, the die 3, the mandrel 4 and the punch 17 are supported rotatably relative to each other, the foregoing problem will not occur at all. Consequently, the helical internal gear can be formed plastically with a high degree of accuracy.

Figure 4:
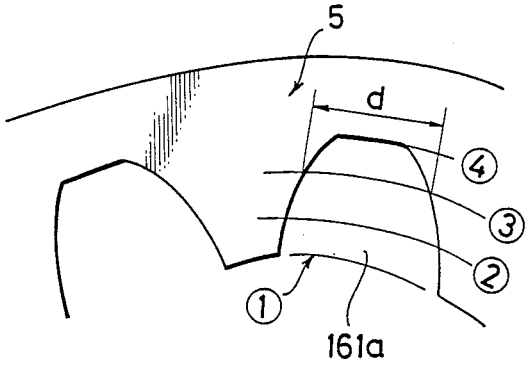
FIG. 4 is an explanatory view showing the varying contour of an approach area of a lower mandrel toothed portion.

Further, since the approach area 161*a* in the toothed section 161 of the lower mandrel 16 for molding the helical teeth is designed to have an inclined sectional shape with an upward slope in the extruding direction of the metal material, as indicated by 1–4 in FIG. 4, it is possible to highly accurately form the helical teeth on the material without imposing undue forces and to simplify the molding process, with the result that rigidity of the toothed section 161 can be increased and the service life of the die unit can be improved.

Next, another embodiment of the present invention will be described with reference to FIGS. 7 to 11.

Figure 7:
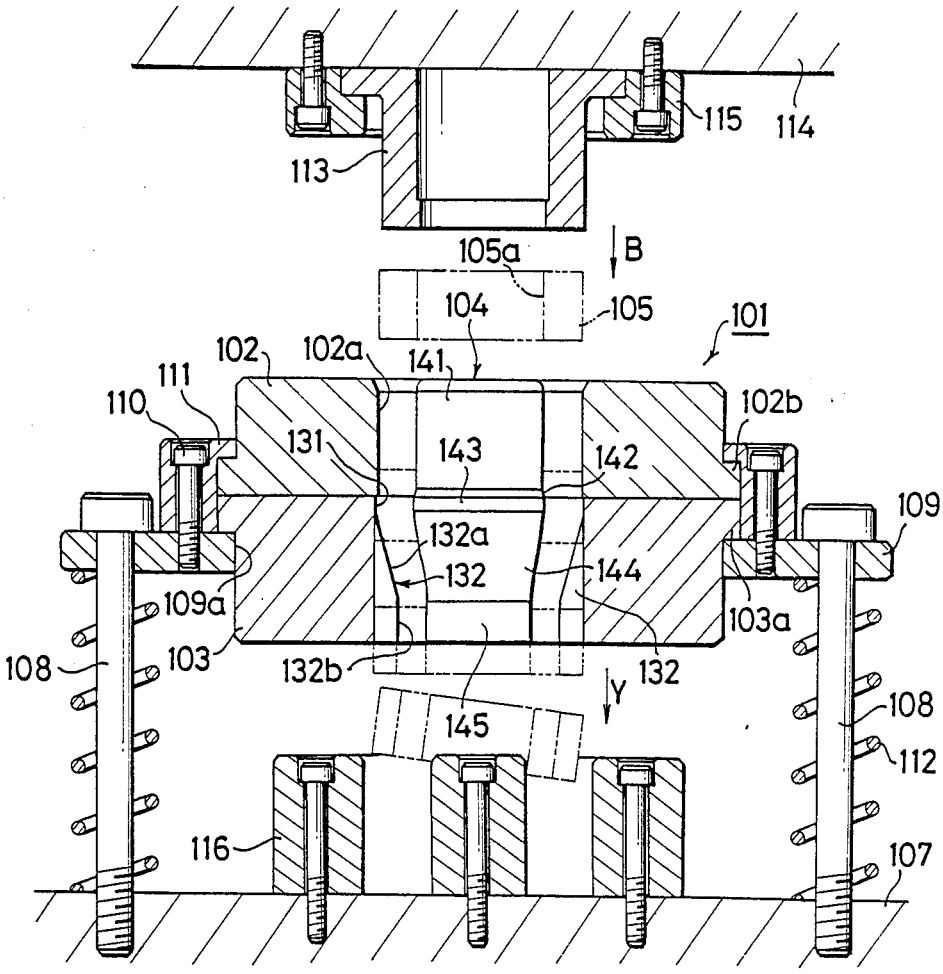
FIG. 7 is a sectional view showing one example of an apparatus for plastically forming helical gears according to the present invention.
Figure 8:
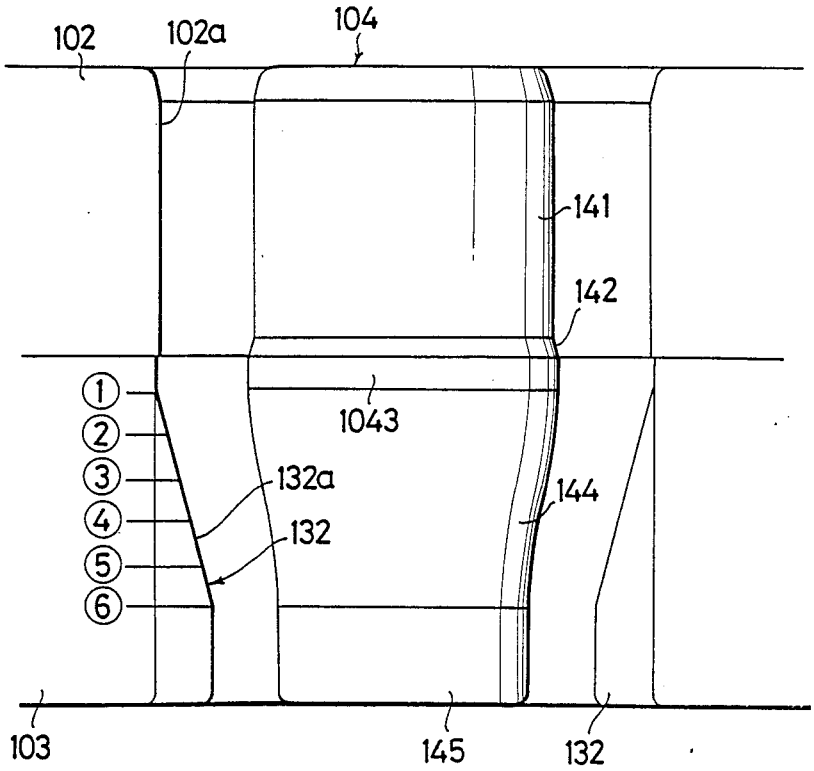
FIG. 8 is an enlarged sectional view of an essential part of the apparatus.
Figure 9:
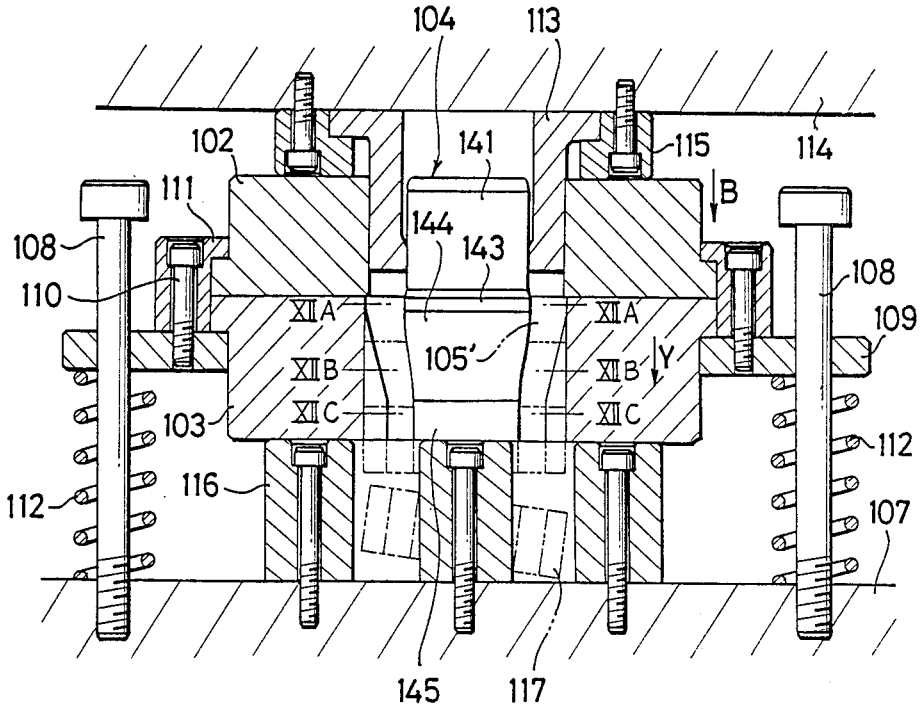
FIG. 9 is a sectional view showing the state that a metal material is pushed into a die to extrude a helical gear.

FIG. 7 is a sectional view showing the entire construction of an apparatus for plastically extruding helical gears according to the present invention, FIG. 8 is an enlarged sectional view of an essential part of the apparatus, and FIG. 9 is a sectional view showing the state that a metal material is pushed into a die to extrude a helical gear.

Referring to FIGS. 7 to 9, a helical gear extruding die unit generally designated as reference numeral 101 comprises a container 102, a die 103 and a mandrel 104. At the center of the container 102, there is defined a material insertion bore 102*a* which vertically penetrates through the container and serves to restrain the outer contour of a metal material blank 105.

The die 103 is to form helical teeth on the outer periphery of the metal material blank 105 by pushing it into the die 103, and it is rotatably fitted in an attachment hole 109*a* of a support plate 109 vertically movably supported to a plurality of upstanding guide rods 108 which are in turn attached to a stationary base 107 such as a bolster. The container 102 is placed over the upper surface of the die 103 with their axes aligned exactly. The container 102 and the die 103 have formed in their outer circumferences respective flanges 102*b*, 103*a* at which they are supported on the support plate 109 by a ring-like holder 111, fixed to the support plate 9 by means of bolts 110, for being circumferentially rotatable relative to each other. The support plate 109 is normally urged upward by compression springs 112 each disposed between the support plate 109 and the stationary base 107 around the guide rod 108 in concentric relation.

Further, the die 103 has a cylindrical bore 131 with the diameter slightly larger than the material insertion bore 102*a* of the container 102, and a toothed section 132 with a desired helical angle is defined on an inner wall of the cylindrical bore 131 for molding helical teeth of the helical gear. As shown in FIG. 8, the toothed section 132 comprises an approach area (tooth deformation process area) 132*a* expanding linearly radially from the inner surface of the cylindrical bore 131 toward the center as it goes ahead in the extruding direction of the metal material blank 105 (i.e., the direction of arrow Y in FIG. 8) and, a product configuration area 132*b* extending downward continuously from the lower end of the approach area 132*a* to form the complete shape of helical gear teeth. In the approach area 132*a*, each tooth has such sectional configurations at respective positions 1–6 that a tooth groove width d is gradually reduced in accordance with the involute curve of the molded tooth as it proceeds from the inner surface of the cylindrical bore 131 toward the center, as indicated by 1–6 in FIG. 10. This increases flextural rigidity of the start end portion of the approach area 132*a* (i.e., the portion corresponding to 2) from which the metal material blank 105 starts to undergo flow deformation along the approach area 132*a*, and also enables a smooth transition process of the metal material blank 105 to the helical gear teeth through flow deformation.

The mandrel 104 is disposed in alignment with the axes of the material insertion bore 102*a* of the container 102 and the cylindrical bore 131 of the die 103, and comprises a column portion 141 located inside the material insertion bore 102*a* of the container 102 for guiding the metal material blank 105 when its central bore 105*a* is fitted over the column portion 141, and an outwardly expanded portion 143 which is continuously extended from the lower end of the column portion 141 through a tapered portion 142 and located inside the cylindrical bore 131 of the die 103 for defining the sectional area of the metal material blank 105 necessary to mold the helical gear, a material inner periphery forming portion 144 which is continuously extended from the lower end of the outwardly expanding portion 143 in facing relation to the approach area 132*a* in the toothed section of the die 103, and serves to restrain the inner periphery of the metal material blank 105 while allowing it to contract inward in response to effective contraction of the outer diameter of the metal material blank 105 during the process in which the outer peripheral portion of the metal material blank 105 is subjected to flow deformtion gradually from the circular cross-section to the helical gear teeth by virtue of the toothed section 132 of the die 103, and another column portion 145 which is continuously extended from the lower end of the material inner periphery forming portion 144 in facing relation to the product configuration area 132*b* of the die 103 for defining the normal inner diameter of the helical gear to be molded.

Designated at 113 in FIGS. 7 and 9 is a cylindrical punch supported to the underside of a slider 114 by a holder 115. The punch 113 is to push the metal material blank 105 into a gap between the mandrel 104 and the container 102 as well as the die 103, and is supported in such an arrangement as making it rotatable circumferentially relative to the slider 114.

Operation of extruding helical gears using the die unit 101 thus constructed will be described below.

First, as shown in FIG. 7, the hollow metal material blank 105 with predetermined thickness and outer diameter is inserted into the bore 102*a* of the container 102, and the slider 114 is operated to descend into the direction of arrow B with the central bore 105*a* of the metal material blank 105 fitted over the column portion 141 of the mandrel 104. When the punch 113 is thereby engaged with the upper end of the metal material blank 105 and then further moved downward, the support plate 109 is wholly descended against the compression springs 112, along with the container 102, the die 103 and the mandrel 104. At the time the lower end surfaces of both the die 103 and the mandrel 104 strike against the upperside of a receiver stand 116 fixedly mounted on the stationary base 107, the downward movement of the container 102, the die 103 and the mandrel 104 is stopped.

In such state, when the slider 114 is advanced in the direction of arrow B causing the punch 113 to be descended at a full stroke, the metal material is pushed more deeply in the gap between the container 102 and the mandel 104 in the extruding direction as indicated by arrow Y, and it finally reaches a position straddling both the container 102 and the die 103 as indicated by reference numeral 105' in FIG. 9.

At the time the metal material is pushed into the die 103 from the container 102 by means of the punch 113, the metal material blank 105' is expanded by the presence of the outwardly expanded area 143 of the mandrel 104 for being defined to the sectional area necessary to mold the helical gear. Then, the outer peripheral portion of the metal material at its lower end enters the approach area 132*a* of the toothed section 132 of the die 103 for molding the helical teeth, whereupon the helical teeth start to be molded on the metal material blank 105'. The material deformation as experienced in the outer peripheral portion of the metal material blank 105' at this time corresponds to the sectional configuration of the approach area 132*a* as indicated by 2 in FIG. 8.

Upon completion of full-stroke pushing of the first metal material blank 105' by the punch 113, the punch 113 is raised up and a next metal material blank 105 is inserted into the container 102, as shown in FIG. 7, followed by moving the punch 113 again downward to push the next metal material blank 105 into the container 102. Thereafter, by successively pushing subsequent metal material blanks 105 into the container 102 by the punch 113 in a like manner, the metal material blanks 105 are moved through the gap between the die 103 and the mandrel 104 one by one in the direction of arrow Y. During passage through the gap between the die 103 and the mandrel 104, each metal material blank 105 is plastically formed into a helical gear having helical teeth on the outer circumference thereof.

Figure 11:
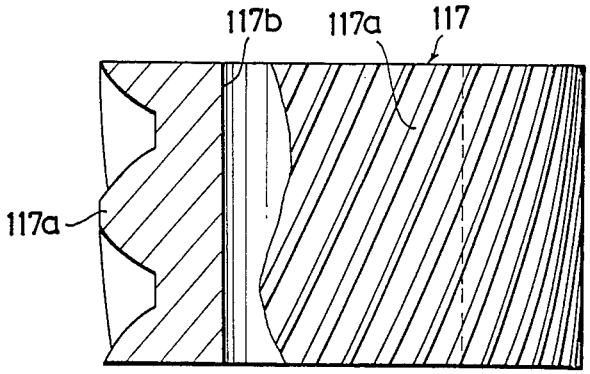
FIG. 11 is a side view, partially broken away, of a molded helical gear.

In other words, when the metal material blank 105 passes the approach area 132*a* of the die 103, the outer peripheral portion of the metal material blank 105 is subjected to flow deformation gradually from the circular cross-section to the complete shape of helical teeth. After that, while passing through the gap between the product configuration area 132*b* and the material inner periphery forming portion 144 of the mandrel 104 both defined in facing relation, the metal material is molded into a helical gear 117 which has perfect helical teeth 117*a* formed in its outer peripheral portion, and has its inner periphery 117*b* formed into the predetermined diameter by the material inner periphery forming portion 144, as shown in FIG. 11. The helical gear 117 is dropped into the receiver stand 116.

In this connection, when each of the metal material blanks 105 successively pushed from above by the punch 113 passes the gap between the approach area 132*a* in the toothed section 132 of the die 103 and the material inner periphery forming portion 144 of the die 3, both defined in facing relation, the outer peripheral portion of the metal material blank 105 is subjected to flow deformation from the incomplete toothed shape to the complete toothed shape as it goes down from the upper end of the approach area 132*a* to the lower end thereof. Simultaneously, the flow material caused by effective contraction of the outer diameter of the metal material blank 105*a* during the above process of tooth deformation is absorbed by the presence of the material inner periphery forming portion 144 which is inclined contractedly in complementary relation to the approach area 132*a*, so that the metal material blank 105 is prevented from undergoing flow extension in the axial direction of the mandrel 104.

Thus, reduction in the horizonal sectional area of the material blank 105 caused by flow deformation of the outer peripheral portion of the metal material blank 105 from the circular cross-section to the helical toothed shape is compensated by such an arrangement that the material inner periphery forming portion 144 of the mandrel 104 serving to restrain the inner periphery of the metal material blank 105 is designed to vary in its diameter corresponding to changes in the sectional configuration of the inclined approach area 132*a*, thereby keeping constant the horizontal sectional area of the metal material blank 105 throughout the region of material flow deformation in the die unit.

FIG. 12 is a set of explanatory views showing the fact that the sectional areas at respective horizontal planes of the metal material are kept constant throughout the molding process of the helical gear in the die unit.

Figure 12A:
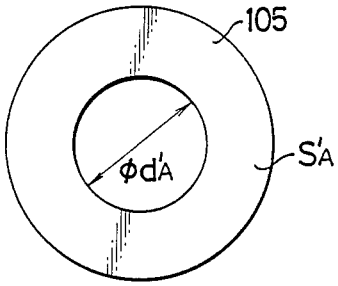
FIGS. 12(A) to 12(C) are explanatory views showing respective horizontal cross-sectional states in the flow deformation process of the material according to the embodiment of the present invention.
Figure 12B:
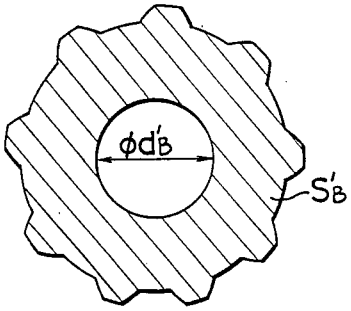
Figure 12C:
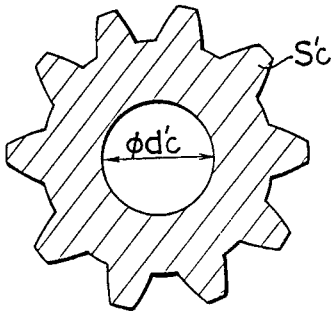

FIG. 12(A) shows a section of the metal material blank 105 at the horizontal plane taken along the line XIIA—XIIA in FIG. 9, FIG. 12(B) shows a section of the metal material blank 105 under molding at the horizontal plane taken along the line XIIB—XIIB in FIG. 9, and FIG. 12(C) shows a section of the final product at the horizontal plane taken along the line XIIC—XIIC in FIG. 9.

As will be apparent from those figures, the sectional area $S'_A$ of the metal material blank 105 being outwardly expanded by the outwardly expanding portion 143 of the mandrel 103, the sectional area $S'_B$ of the metal material during flow deformation, and the sectional area $S'_C$ of the completed gear area equal to each other, i.e., $S'_A = S'_B = S'_C$, although the respective internal diameters $\emptyset d'_A$, $d'_B$ and $\emptyset d'_C$ exhibit the relationship of $\emptyset d'_A > \emptyset d'_B > \emptyset d'_C$.

Accordingly, the material extension in the axial direction of the metal material blank 105 is prevented, and there occurs no gap between the lead of the incomplete toothed shape formed in the outer circumference of the material and the lead of the die toothed section held in contact with the former, even in the transition process from the approach area 132*a* of the die 103 to the product configuration area 132*b* for molding a complete toothed shape. Also, there occurs no lead error in the direction of advancement between the toothed section molded in the outer circumference of the material and the corresponding toothed section of the die 103, whereby perfect helical teeth are formed in the outer circumference of the material.

In addition, when the metal material blank 105 pushed downward by the punch 113 passes the toothed section 132 of the die 103 while undergoing flow deformation, relative rotational forces are produced between the metal material blank 105 and the die 103 due to the helical angle of the toothed section 132. Stated otherwise, supposing for the die 103 to be held stationary, the entire metal material blank 105 is necessarily forced to rotate due to the helical lead of the toothed section 132 when the metal material blank 105 is pushed to come into the toothed section 132 of the die 103. In this state, because the most part of the metal material is in the container 102, the metal material has to rotate by overcoming the frictional resistance between the container 102 and the metal material, if the die 103 is integral with the container 102, or if the relative rotational movement is restricted between the die 103 and the container 102. At this time, a portion of the metal material blank 105 just enters the approach area 132*a* of the die 103, and hence rotation of the metal material blank 105 produces extreme stress in the approach area 132*a*. As a result, the metal material blank 105 would be deformed unnecessarily, or the toothed section 132 of the die 103 would be damaged.

In this embodiment, however, since the container 102, the die 103, the mandrel 104 and the punch 113 are supported rotatably relative to each other, the foregoing problem will not occur at all. Consequently, the helical gear can be formed plastically with a high degree of accuracy.

Figure 10:
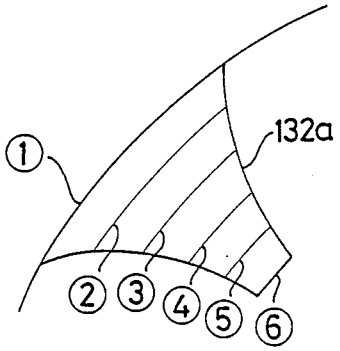
FIG. 10 is an explanatory view showing the varying contour of an approach area of a die toothed portion.

Further, since the approach area 132*a* in the toothed section 132 of the die 103 for molding the helical teeth is designed to have an inclined sectional shape with an upward slope in the extruding direction of the metal material, as indicated by 1–6 in FIG. 10, it is possible to form the helical teeth on the material highly accurately without imposing undue forces and to simplify the molding process, with the result that rigidity of toothed section 132 can be increased and the service life of the die unit can be improved.

What is claimed is:

1. A method of plastically forming a helical internal gear, that employs a helical internal gear extruding die unit consisting of: an outer contour restraining container into which metal material blanks each having a central bore are to be inserted, a die placed contiguously below said container, said container and said die being arranged so as to be circumferentially rotatable relative to each other, an upper mandrel for guiding, and a lower mandrel formed on its outer circumference with a toothed section with a desired helical angle for forming helical teeth of the helical internal gear, said upper and lower mandrels being disposed inside said outer contour restraining container and said die in alignment with their axes, respectively, and being connected to be circumferentially rotatable relative to each other, said method comprising the steps of: pushing the metal material blanks successively into gaps between said upper mandrel and said outer contour restraining container and between said lower mandrel and said die by means of a punch; contracting each of the metal mandrels by an inwardly contracted portion of said die to define the sectional area as necessary to mold the helical internal gear when the metal material passes between said die and said lower mandrel; and subjecting the inner peripheral portion of the metal material to flow deformation from an incomplete toothed shape to a complete toothed shape as it goes from the upper end of an approach area in the toothed section of said lower mandrel toward the lower end thereof, when the metal material passes between said approach area and a material outer periphery expanding portion of said die located in facing relation to the former during said steps said lower mandrel being allowed to rotate due to relative rotational forces produced between the metal material and said lower mandrel caused by the helical angle of said toothed section, and also, due to effective expansion of the inner diameter of the metal material during the toothed shaped forming process, flow material being absorbed by said material outer periphery expanding portion; such portion being inclined expansively in complementary relation to said approach area of said lower mandrel, thereby keeping constant the horizontal sectional area of the metal material throughout the region of material flow deformation in said due unit.

2. An apparatus for plastically forming a helical internal gear comprising: an outer contour restraining container into which metal material blanks each having a central bore are to be inserted; a die placed contiguously below said outer contour restraining container and arranged to be circumferentially rotatable relative to said container; an upper mandrel disposed inside said outer contour restraining container in alignment with its axis; a lower mandrel connected to the lower end of said upper mandrel for being circumferentially rotatable relative to said upper mandrel and disposed in said die in alignment with its axis; and a punch for successively pushing the metal material blanks into gaps between said upper mandrel and said outer contour restraining container and between said lower mandrel and said die, wherein the outer peripheral wall of said lower mandrel has formed therein an approach area in which the peripheral surface is gradually varied into a toothed shape of the helical internal gear as it goes ahead from the upper end thereof in the extruding direction of the metal material, and a product configuration area continuously extended from said approach area and having the toothed shape of the helical internal gear, and wherein the inner peripheral surface of said die has formed therein an inwardly contracted portion located facing the start end of said approach area of said lower mandrel for contracting the metal material to define its sectional area necessary for molding the helical internal gear, an outer periphery expanding portion located facing said approach area of said lower mandrel for expansively deforming the outer periphery of the metal material to keep constant the horizontal sectional area thereof despite effective expansion of the inner diameter of the metal material during the flow deformation process in which the inner peripheral portion of the metal material is formed gradually into the toothed shape of the helical internal gear by said approach area, and an outer periphery forming portion located facing the product configuration area of said lower mandrel for defining the outer diameter of the molded product to the normal size.

3. A method of plastically forming a helical gear that employs a helical gear extruding die unit consisting of an outer contour restraining container into which metal material blanks each having a central bore are to be inserted, a die placed contiguously below said container, said container and said die being circumferentially rotatable relative to each other, and a mandrel disposed inside said outer contour restraining container and said die in alignment with their axes, and arranged to be rotatable circumferentially relative thereto, said method comprising the steps of: pushing the metal material blanks successively into gaps between said mandrel and said outer contour restraining container as well as said die by means of a punch; defining the sectional area of the metal material necessary to mold the helical gear by a sectional area reduction rate adjusting portion of said mandrel, when the metal material passes between said die and said mandrel; and subjecting the outer peripheral portion of the metal material to flow deformation from an incomplete toothed shape to a complete toothed shape as it goes from the upper end of an approach area in a toothed section of said die for molding helical teeth toward the lower end thereof, when the metal material passes between said approach area and a material inner periphery forming portion of said mandrel located in facing relation to the former; during said steps said die being allowed to rotate due to relative rotational forces produced between the metal material and said die caused by the helical angle of said toothed section, and also, flow material due to effective contraction of the outer diameter of the metal material during the toothed shape forming process, flow material being absorbed by said material inner periphery forming portion; said portion being inclined contractedly in complementary relation to said approach area of said die, thereby keeping constant the horizontal sectional are of the metal material throughout the region of material flow deformation in said die unit.

4. An apparatus for plastically forming a helical gear comprising: an outer contour restraining container into which metal material blanks each having a central bore are to be inserted; a die placed contiguously below said outer contour retraining container and arranged to be circumferentially rotatable relative to said container; and a mandrel disposed inside said outer contour restraining container and said die in alignment with their axes; and a punch for successively pushing the metal material blanks into gaps between said mandrel and said outer contour restraining container as well as said die, wherein the inner peripheral wall of said die has formed therein an approach area in which the peripheral surface is gradually varied into the toothed shape of the helical gear as it goes ahead from the upper end thereof in the extruding direction of the metal material, and a product configuration area continuously extended from said approach area and having the toothed shape of the helical gear, and wherein the outer peripheral surface of said mandrel has formed therein a sectional area reduction rate adjusting portion located in a position near said outer contour restraining container for expanding the metal material to define its sectional area necessary for molding the helical gear, an inner periphery forming portion located facing said approach area of said die for contractedly deforming the inner periphery of the metal material to keep constant the horizontal sectional area thereof despite effective contraction of the outer diameter of the metal material during the flow deformation process in which the outer peripheral portion of the metal material is formed gradually into the toothed shape of the helical gear by said approach area, and a column portion located facing the product configuration area of said die for defining the inner diameter of the molded product to the normal size.

* * * * *

UNITED STATES PATENT AND TRADEMARK OFFICE

CERTIFICATE OF CORRECTION

PATENT NO. : 4,924,690

DATED : May 15, 1990

INVENTOR(S) : H. Kanamaru et al

It is certified that error appears in the above-identified patent and that said Letters Patent is hereby corrected as shown below:

Col. 14, line 40, replace "connected" with --interconnected--.

Col. 15, line 2, replace "due" with --die--.

Col. 16, line 21, replace "are" with --area--.

Col. 16, line 27, replace "retraining" with --restraining--.

Signed and Sealed this

Twenty-third Day of July, 1991

*Attest:*

*Attesting Officer*

HARRY F. MANBECK, JR.

*Commissioner of Patents and Trademarks*